US005980402A

United States Patent [19]

DeGaris

[11] Patent Number: 5,980,402

[45] Date of Patent: Nov. 9, 1999

[54] ULTRA-THIN RACQUET FRAME

[76] Inventor: Kenneth Godfrey DeGaris, P. O. Box 267, Carlingford, New South Wales 2118, Australia

[21] Appl. No.: 09/090,657

[22] Filed: Jun. 4, 1998

Related U.S. Application Data

[63] Continuation-in-part of application No. 08/586,802, filed as application No. PCT/AU94/00447, Aug. 5, 1994, Pat. No. 5,762,571.

[30] Foreign Application Priority Data

Aug. 5, 1993 [AU] Australia ..... PM 0385

[51] Int. Cl.[6] ..... A63B 49/00

[52] U.S. Cl. ..... 473/537; 473/524

[58] Field of Search ..... 473/524, 537, 473/525, 526, 527, 538

[56] References Cited

U.S. PATENT DOCUMENTS

| | | | |
|---|---|---|---|
| 1,539,019 | 5/1925 | Nikonow | 473/537 |
| 4,903,967 | 2/1990 | Ferrari et al. | 473/537 |
| 5,071,124 | 12/1991 | Davis | 473/537 |
| 5,076,583 | 12/1991 | Hsu | 473/537 |
| 5,249,798 | 10/1993 | Miyamoto | 473/537 |
| 5,277,422 | 1/1994 | Coe | 473/537 |
| 5,312,102 | 5/1994 | Stennett | 473/537 |
| 5,374,058 | 12/1994 | Janes et al. | 473/537 |
| 5,470,061 | 11/1995 | Colburn et al. | 473/537 |
| 5,470,062 | 11/1995 | Takatsuka | 473/537 |

*Primary Examiner*—Sam Rimell
*Attorney, Agent, or Firm*—Edwin D. Schindler

[57] ABSTRACT

A tennis racquet frame including a handle having a free end, a racquet head defined by a closed loop frame, a bridge that defines a portion of the closed loop frame of the racquet head and a throat connecting the racquet head to the handle, with the closed loop frame having a first half remote from the handle and a second half being closer to the handle. The mid-section of the racquet extends from and includes the second half of the closed loop frame and the throat, to a point approximately 20 centimeters from the free end of the handle, in which the thickness of at least 25% of the mid-section, more preferably, at least 50% of the mid-section, and most preferably, at least 75% of the mid-section, is less than approximately 60% of the maximum thickness of the racquet in the first half of the closed loop frame. A tennis racquet having similar features for an open loop frame, but not having a bridge, is also disclosed.

9 Claims, 4 Drawing Sheets

ULTRA-THIN RACQUET FRAME

CROSS-REFERENCE TO RELATED APPLICATION

This is a continuation-in-part of application Ser. No. 08/586,802, filed May 1, 1996, which is the U.S. National Phase of P.C.T. International application No. PCT/AU94/00447, filed Aug. 5, 1994, now U.S. Pat. No. 5,762,571, issued Jun. 9, 1998.

BACKGROUND OF THE INVENTION

1. Technical Field of the Invention

The present invention relates to tennis racquets and, in particular, to a tennis racquet which has a relatively thin frame in the deemed mid-section of the racquet when compared to the thickness of the frame of the other sections of the racquet.

As used in this Specification the thickness of the frame of the racquet is the dimension measured from the front and back faces of the frame at any given point.

2. Description of the Prior Art

Tennis racquets have normally had medium to relatively thick frames providing support around their head and mid-section. However, with the advent of newer and stronger materials, it is believed that superior performance characteristics such as increased control and maneuverability can be achieved over the normal performance characteristics of existing racquets if thinner frames are used.

SUMMARY OF THE INVENTION

It is, therefore, an object of the present invention to provide performance characteristics which are superior to those of existing racquets.

Additionally, a tennis racquet with an ultra-thin portion of its frame, in accordance with the present invention, will further allow for the creation of greater spin on shots, provide less wind resistance, which enhances swing speeds and greatly reduces racquet vibration and shock upon impact with a ball, which in turn, reduces the occurrence of arm and related injuries.

The foregoing and related objects and advantages can be accomplished by means of the present invention described herein, in which it has been found to be advantageous to provide a tennis racquet with an ultra-thin portion of its frame.

According to one aspect of the present invention there is provided a tennis racquet comprising:

a handle having a free end;

a racquet head defined by a loop frame;

a bridge that defines a portion of the loop frame of the racquet head; and, a throat connecting the racquet head to the handle, with the loop frame having a first half remote from the handle and a second half being closer to the handle, wherein a mid-section of the racquet extends from, and includes, the second half of the loop frame and the throat, to a point approximately 20 centimeters from the free end of the handle, characterized in that the thickness of the racquet of any part of the mid-section is less than approximately 60% of the maximum thickness of the racquet in the first half of the loop frame.

While the thickness of the racquet of any part of the mid-section is less than approximately 60% of the maximum thickness of the racquet in the first half of the loop frame, preferably, at least 25% of the mid-section, more preferably, at least 50%, and most preferably, at least 75% of the mid-section is less than approximately 60% of the maximum thickness of the racquet in the first half of the loop frame.

The loop frame of the racquet can either be a closed loop frame or an open loop frame.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
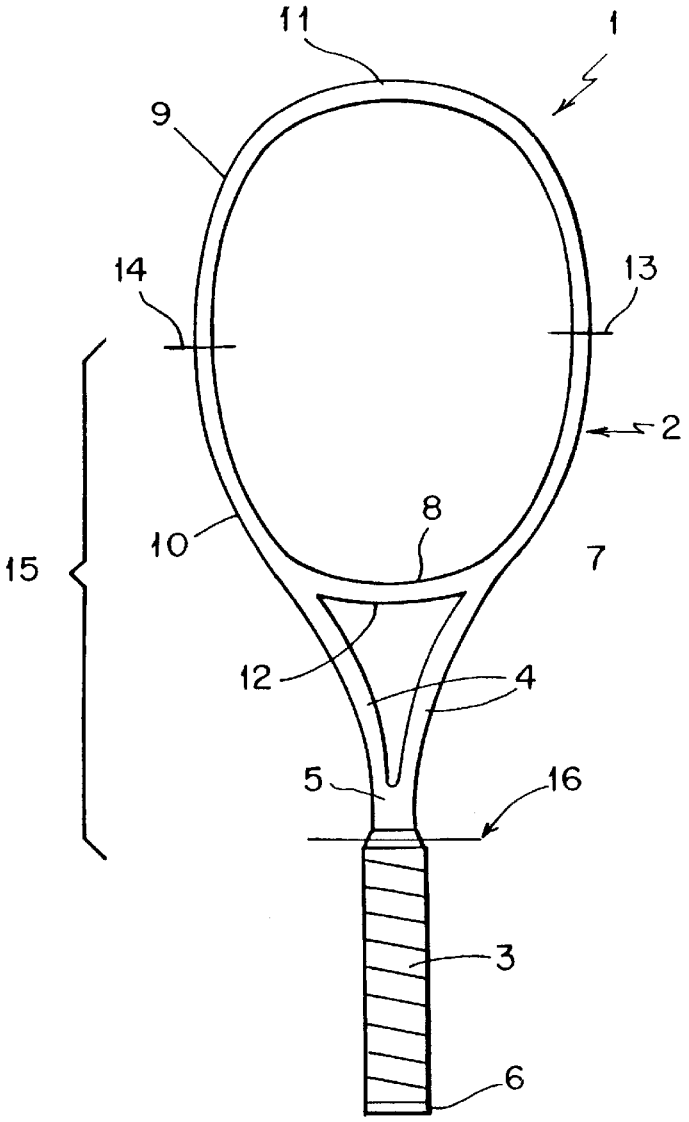
FIG. 1 is a face view of a game racquet of a first embodiment in accordance with the present invention.
Figure 2:
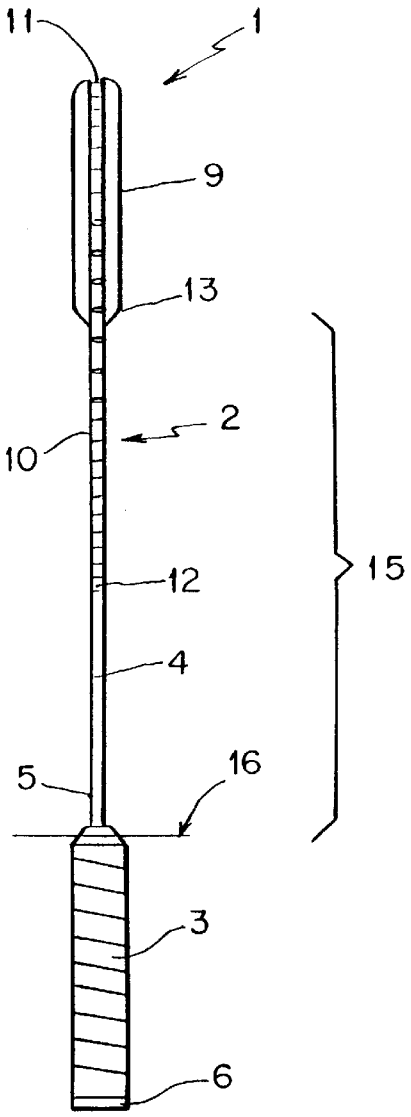
FIG. 2 is a side view of the game racquet of FIG. 1.

Turning now, in detail, to an analysis of the accompanying drawing figures, a tennis racquet 1 of a first embodiment of the present invention is illustrated in FIGS. 1 and 2. Racquet 1 is illustrated as a frame only without the strings attached. Racquet 1 has a racquet head 2 connected to a handle 3 by a throat 4 and a shaft 5, with shaft 5 being connected to handle 3 and two members of throat 4 being connected between shaft 5 and racquet head 2. Handle 3 has a butt 6 at its free end. Racquet head 2 comprises a closed loop frame 7, which has a bridge 8 as a portion of the closed loop frame 7. Bridge 8 forms the portion of the closed loop frame 7 between the connection points of the two members of throat 4.

Racquet head 2 can be divided into two halves with a top half 9 being remote from handle 3 with the lower half 10 being closer to handle 3. Lower half 10 includes bridge 8. The two halves 9 and 10 can be visualized by identifying the tip 11 or the twelve-o'clock position, at the top of racquet head 2; and the base 12 or six-o'clock position, at the base of racquet head 2. By visualizing a line drawn between the tip 11 and base 12, and by dividing it into two halves, a three-o'clock point 13 and a nine-o'clock point 14 can be identified and the two halves 9 and 10 are determined.

A "mid-section" 15 of racquet 1 is defined as being that section of the racquet 1 which extends between a line between the points 13 and 14, on the one hand, and a point 16, which is approximately 20 centimeters up handle 3 from its free end having butt 6. Therefore, the mid-section 15 of racquet 1 of the embodiment as illustrated in FIGS. 1 and 2 comprises the lower half 10 of racquet head 2, throat 4, shaft 5 and bridge 8. It is noted that other tennis racquets (not illustrated), which may have different length handles, such as a racquet which is used by a double-handed backhand player, can include a portion of its handle within mid-section 15.

Tennis racquet 1 of this first preferred embodiment is constructed such that the thickness of the frame of the racquet in its mid-section 15 is less than 12 millimeters. In this particular embodiment, as illustrated in FIG. 2, it is seen that all of the frame of the mid-section 15 is less than 12 millimeters while the remainder of the frame, as contained in the top half 9 of racquet head 2 and handle 3 is thicker.

Conventional tennis racquets, as known in the art, have head frame thicknesses of approximately 20 millimeters, while known wide body tennis racquets have head frame thicknesses in the range of approximately 20–36 millimeters. The head frame thickness, as used in the construction of conventional tennis racquets, is illustrated as racquet 1 in the drawing figures and, therefore, has a thickness in the top half 9 of the racquet head of approximately 20 millimeters. Therefore, the thickness of the mid-section 15 is less than 12 millimeters, or approximately 60% of the maximum thickness of the top half 9 of racquet head 2. This means that racquet 1 has enough structural strength to be used in the game of tennis, while the thin frame of the mid-section 15 provides the racquet with the desired performance characteristics.

It is noted that even though the embodiment as illustrated in FIGS. 1 and 2, has the entire mid-section 15 with a thickness of less than 12 millimeters and, therefore, less than 60% of the maximum thickness of the top half 9 of racquet head 2, it is within the scope of the present invention, for tennis racquet 1 to have any part of the mid-section 15 having a thickness less than 12 millimeters, as this would accomplish the aims of the invention. It is not necessary for the thickness of the entire mid-section to be less than 12 millimeters or 60% of the maximum thickness of the top half 9 of racquet head 2.

Figure 3:
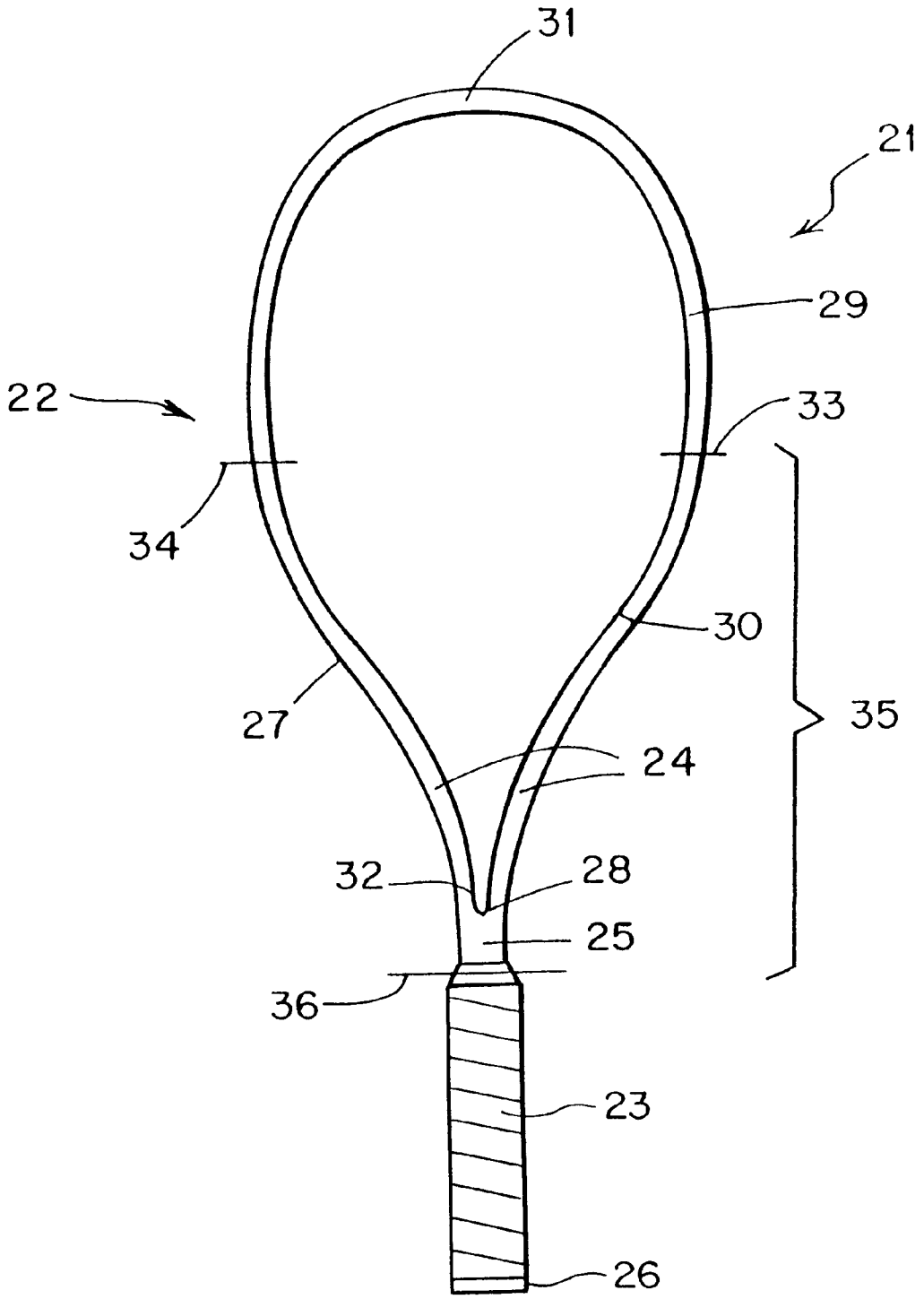
FIG. 3 is a face view of a game racquet of a second embodiment in accordance with the present invention.

Tennis racquet 21 of a second embodiment of the present is illustrated in FIG. 3 as a frame without the strings attached. It is noted that the side view of racquet 21 is the same as the side view of the first embodiment as illustrated in FIG. 2. Racquet 21 has a racquet head 22, comprising an open loop frame 27 and a throat 24, which is connected to a shaft 25 at its top section 28. Shaft 25, in turn, connects to a handle 23, which has a butt 26 at its free end. Throat 24 comprises two members which are extensions of open loop frame 27, and which are joined at the top section 28 of shaft 25. In this embodiment, there is no bridge portion corresponding to bridge 8 of the first embodiment as racquet 21 takes the shape of a "tear drop."

Like the first embodiment, racquet head 22 can be divided into two halves with the top half 29 being remote from handle 23 with the lower half 30 being closer to handle 23. The two halves 29 and 30 can be visualized by identifying the tip 31, or the twelve-o'clock position, at the top of racquet head 22; and the base 32, or six-o'clock position, at the top section 28 of shaft 25. By visualizing a line drawn between tip 31 and base 32, and by dividing it into two halves, a three-o'clock point 33 and a nine-o'clock point 34 can be identified and the two halves 29 and 30 are determined. In this embodiment, the lower half includes throat 24 of racquet 21.

A "mid-section" 35 of racquet 21 is defined as being that section of racquet 21 which extends between a line between points 33 and 34, on the one hand, and a point 36, which is approximately 20 centimeters up handle 23 from its free end having the butt 26. Therefore, the mid-section 35 of racquet 21 of the embodiment, as illustrated in FIG. 3, comprises the lower half 30 of racquet head 22 (including throat 24) and shaft 25. It is noted that other tennis racquets (not illustrated), which may have different length handles, such as a racquet which is used by a double-handed backhand player, can include within mid-section 35 a portion of its handle.

Tennis racquet 21 of this second preferred embodiment is constructed such that the thickness of the frame of the racquet in its mid-section 35 is less than 12 millimeters, in a similar manner to the first embodiment. In this particular embodiment, similar to the first embodiment, the entirety of the frame of mid-section 35 has a thickness which is less than 12 millimeters, while the remainder of the frame, as contained in the top half 29 of racquet head 22, and the handle are thicker, and in the case of the head frame thicknesses of the top half 29 of racquet head 22, is approximately 20 millimeters, as described in the previously described embodiment corresponding to a conventional racquet. Therefore, the thickness of mid-section 15 is less than approximately 60% of the maximum thickness of the top half 29 of racquet head 22. This means that racquet 21 has enough structural strength to be used in the game of tennis, while the ultra-thin frame of mid-section 35 provides the racquet with the desired performance characteristics.

Figure 4:
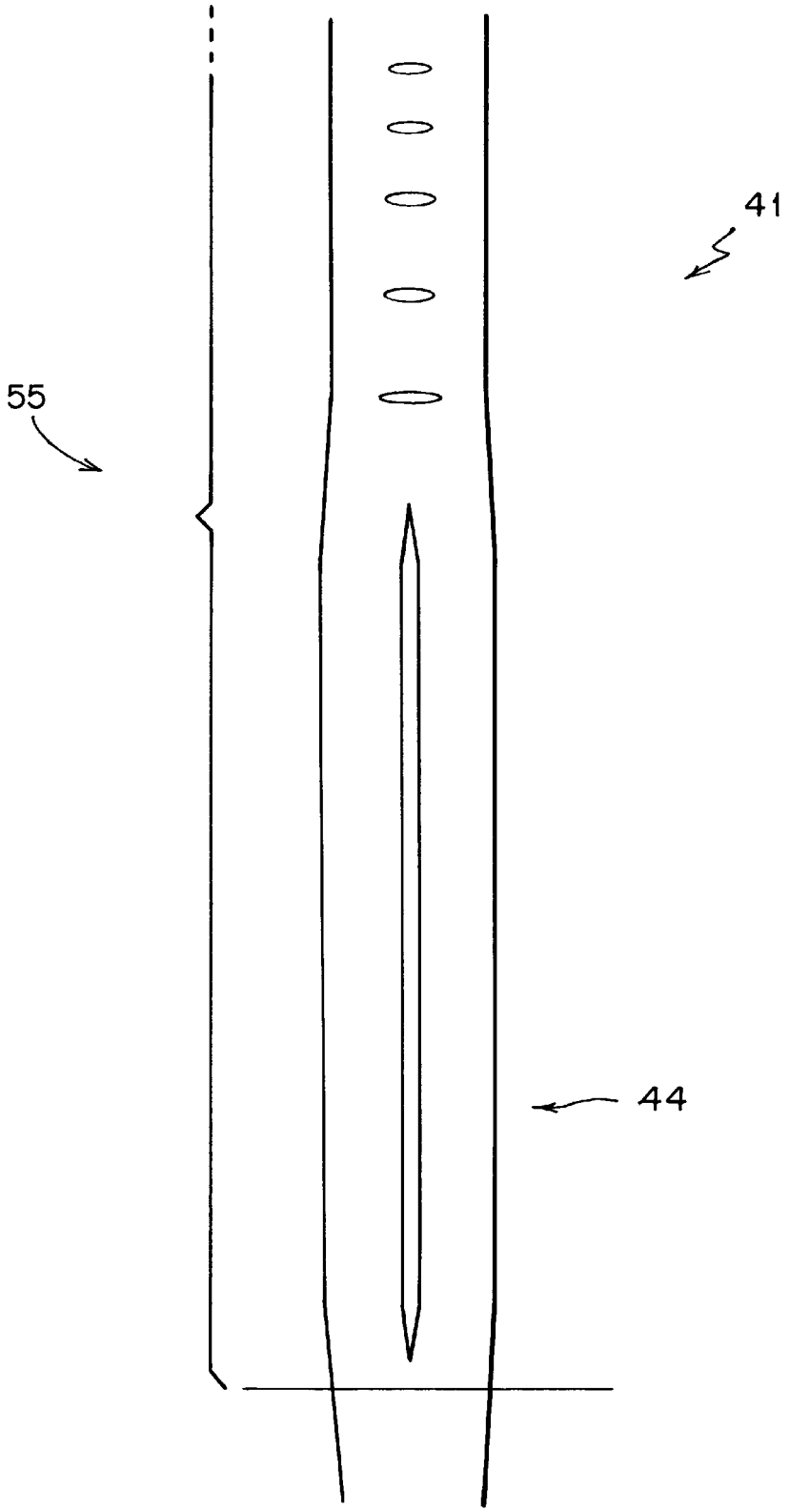
FIG. 4 is a partial detailed side view of a game racquet of a third embodiment in accordance with the present invention; and, FIG. 5 is a face view of a game racquet of a fourth embodiment in accordance with the present invention.

An enlarged side view of a tennis racquet 41, showing a detailed view of the throat area of a third embodiment of the invention is illustrated in FIG. 4. The face view is the same as the face view of the first embodiment, as illustrated in FIG. 1. Racquet 41 is illustrated as a frame only without the strings attached. Racquet 41 is similar to the first embodiment, except that the two members of throat 44 have split frames as seen in FIG. 4. The remainder of racquet 41 is the same as racquet 1. Racquet 41 has a defined mid-section 55 in the same way as the first embodiment. No further description of this arrangement is submitted to be necessary, as it is the same as described with respect to the first embodiment of the invention.

Tennis racquet 41 of this third preferred embodiment is constructed such that the thickness of each of the segments of the split frame of racquet 41 in its mid-section 55 is less than 6 millimeters, or 30%, of the maximum thickness of the head frame thicknesses of the top half of the head. In a similar manner to the first embodiment, the remainder of the frame, as contained in the top half of the head and the handle, is relatively thicker, in accordance with the previous description. This means that racquet 41 has sufficient structural strength to be used in the game of tennis, while the ultra-thin frame of mid-section 55 provides the racquet with the desired performance characteristics.

It is noted that even though the embodiment, as illustrated in FIG. 4, has the entire mid-section 55 with a thickness of less than 12 millimeters, where the frame is a single portion and the entire length of each of the two segments of the split frame has a thickness of less than 6 millimeters, it is within the scope of the present invention for a tennis racquet to have any part of the mid-section 55 of less than 12 millimeters thick and any part of the split frames less than 6 millimeters thick, as this would accomplish the objects of the present invention. It is not necessary for the entire single portion of the frame in the mid-section to be less than 12 millimeters, or the entire length of each, or either, of the two segments of the split frame to be less than 6 millimeters thick. Notwithstanding, it is preferable that at least 25% of mid-section 55, more preferably, at least 50%, and most preferably, at least 75%, have a thickness of less than the foregoing dimensions and, therefore, within the scope of the present invention.

A tennis racquet similar to tennis racquet 41 of the third embodiment, without a bridge portion, is also within the scope of the present invention, as the detailed side view of FIG. 4 further illustrates this arrangement when viewed from the side.

Figure 5:
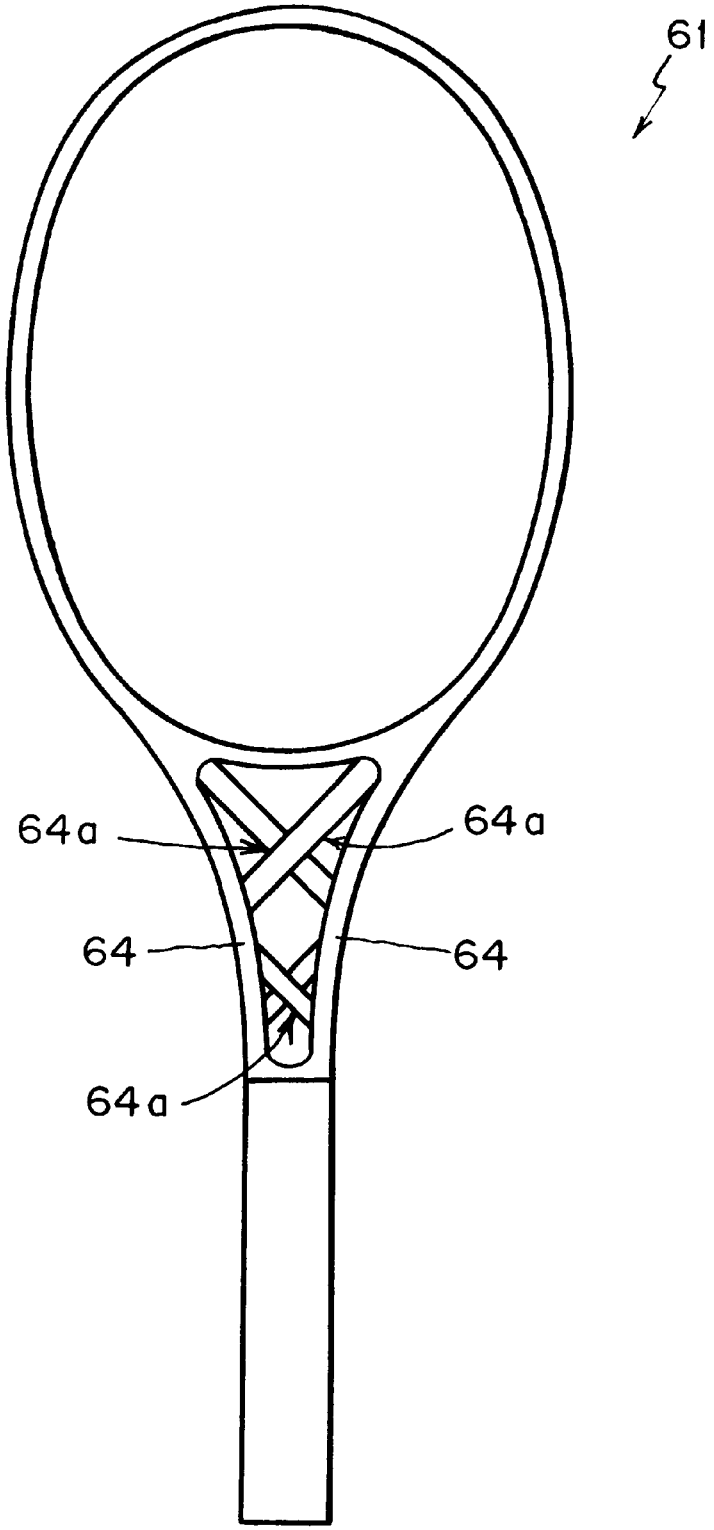

A tennis racquet 61 of a further embodiment of the invention is illustrated in FIG. 5, as a frame without the strings being attached. It is noted that FIG. 2, which illustrates the side view of the first embodiment, is also the side view of the racquet 61. Racquet 61 has the same basic arrangement as racquet 1 in FIG. 1, in that the mid-section is calculated in the same manner. However, unlike racquet 1, racquet 61 has a multi-frame arrangement with primary segments 64 and lattice-like supplementary segments 64*a* in the throat region. The primary segments 64 correspond to throat portion 4 of the first embodiment. Racquet 61 can also be constructed without its bridge portion, as previously described.

In a similar manner to the racquets described heretofore, the thickness of the mid-section is less than 12 millimeters, or 60%, of the maximum thickness of the head frame thicknesses of the top half of the head, as described with respect to the previously discussed embodiments. In this particular arrangement, the thickness of the primary segments 64 is less than 12 millimeters along their entire lengths, but it is within the scope of the present invention for any part of the primary segments to be less than 12 millimeters, in a similar manner to those arrangements previously described. Notwithstanding, it is preferable that at least 25% of the primary segments, more preferably, at least 50%, and most preferably, at least 75%, have a thickness of less than the foregoing dimensions and, therefore, within the scope of the present invention. The thickness of the supplementary segments 64*a* is irrelevant and does not fall within the scope of the present invention.

It is noted that the thickness of the mid-section of the racquets described can be achieved by eliminating much of the frame of the racquet in its mid-section by using lighter and stronger materials, such as titanium or titanium/ceramic compounds in the frame of the tennis racquet.

While only several embodiments of the present invention have been shown and described, it will be obvious to those skilled in the art that many modifications may be made to the present invention without departing from the spirit and scope thereof.

What is claimed is:

1. A tennis racquet frame, comprising:

a handle having a free end;

a racquet head defined by a closed loop frame;

a bridge that defines a portion of the closed loop frame of the racquet head;

a throat connecting the racquet head to the handle; and the closed loop frame having a first half remote from the handle and a second half being closer to the handle, wherein a mid-section of the racquet extends from and includes the second half of the closed loop frame and the throat, to a point approximately 20 centimeters from the free end of the handle, in which the thickness of at least 25% of the mid-section is less than approximately 60% of the maximum thickness of the racquet in the first half of the closed loop frame.

2. The tennis racquet frame according to claim 1, wherein the mid-section includes a portion of the handle.

3. The tennis racquet frame according to claim 1, wherein the mid-section includes a shaft between the throat and the handle.

4. A tennis racquet frame, comprising:

a handle having a free end;

a racquet head defined by a closed loop frame;

a bridge that defines a portion of the closed loop frame of the racquet head;

a throat connecting the racquet head to the handle; and the closed loop frame having a first half remote from the handle and a second half being closer to the handle, wherein a mid-section of the racquet extends from and includes the second half of the closed loop frame and the throat, to a point approximately 20 centimeters from the free end of the handle, in which the thickness of at least 50% of the mid-section is less than approximately 60% of the maximum thickness of the racquet in the first half of the closed loop frame.

5. The tennis racquet frame according to claim 4, wherein the mid-section includes a portion of the handle.

6. The tennis racquet frame according to claim 4, wherein the mid-section includes a shaft between the throat and the handle.

7. A tennis racquet frame, comprising:

a handle having a free end;

a racquet head defined by a closed loop frame;

a bridge that defines a portion of the closed loop frame of the racquet head;

a throat connecting the racquet head to the handle; and the closed loop frame having a first half remote from the handle and a second half being closer to the handle, wherein a mid-section of the racquet extends from and includes the second half of the closed loop frame and the throat, to a point approximately 20 centimeters from the free end of the handle, in which the thickness of at least 75% of the mid-section is less than approximately 60% of the maximum thickness of the racquet in the first half of the closed loop frame.

8. The tennis racquet frame according to claim 7, wherein the mid-section includes a portion of the handle.

9. The tennis racquet frame according to claim 7, wherein the mid-section includes a shaft between the throat and the handle.

* * * * *